US007895871B2

(12) United States Patent
Zieser et al.

(10) Patent No.: US 7,895,871 B2
(45) Date of Patent: Mar. 1, 2011

(54) ROLLING STAND

(75) Inventors: Bernd Zieser, Netphen (DE); Achim Klein, Kreuztal (DE); Florian Lindner, Netphen (DE); Christian Diehl, Hilchenbach (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 1132 days.

(21) Appl. No.: 10/566,313

(22) PCT Filed: Jul. 21, 2004

(86) PCT No.: PCT/EP2004/008130

§ 371 (c)(1),
(2), (4) Date: Jan. 27, 2006

(87) PCT Pub. No.: WO2005/011885

PCT Pub. Date: Feb. 10, 2005

(65) Prior Publication Data

US 2007/0129228 A1 Jun. 7, 2007

(30) Foreign Application Priority Data

Jul. 30, 2003 (DE) ..... 103 34 682

(51) Int. Cl.
*B21B 31/02* (2006.01)
*B21B 29/00* (2006.01)

(52) U.S. Cl. ..... 72/245; 72/241.8

(58) Field of Classification Search ..... 72/245, 72/246, 237, 241.2–241.8; 100/269.03, 269.07
See application file for complete search history.

(56) References Cited

U.S. PATENT DOCUMENTS

| | | | | |
|---|---|---|---|---|
| 4,934,166 | A | 6/1990 | Giacomoni | |
| 6,993,951 | B1 * | 2/2006 | Sudau et al. | 72/241.8 |

FOREIGN PATENT DOCUMENTS

| | | |
|---|---|---|
| EP | 0 256 410 | 2/1988 |
| EP | 0 340 504 | 11/1989 |
| GB | 2 202 173 | 9/1988 |
| JP | 60 257910 | 12/1985 |

* cited by examiner

*Primary Examiner*—Debra M Sullivan
(74) *Attorney, Agent, or Firm*—Lucas & Mercanti, LLP; Klaus P. Stoffel

(57) ABSTRACT

The invention relates to a rolling device (1) comprising at least two working rolls (2, 3) which are respectively mounted in a roll stand (6) by means of working roll assembly pieces (4, 5). At least one of the working rolls (2, 3) is adjustable relative to the other working roll (2, 3) within the roll stand (6), especially in a vertical direction, so as to adjust a desired rolling gap. At east one working roll (2, 3) is effectively connected to bending means (7), with the aid of which said working roll (2, 3) can be impinged upon by a bending moment. The working roll assembly piece (4, 5) is provided with arms (9, 10) that laterally protrude relative to the axis (8) of the working roll (2, 3) to absorb the force generated by the bending means (7). In order to improve the adjustability of the rolling device to a large ascent, a pressure-transmitting element (12) which can be displaced relative to the roll stand (6), particularly in a vertical direction, is disposed between a pressure-generating element (11) of the bending means (7), especially a piston, and the protruding arm (9, 10) of the working roll assembly piece (4, 5).

6 Claims, 9 Drawing Sheets

ROLLING STAND

The invention concerns a rolling device with at least two work rolls, each of which is supported by a work roll chock in a rolling stand, wherein at least one of the work rolls in the rolling stand can be adjusted, especially in the vertical direction, for the purpose of adjusting a desired roll gap relative to the other work roll, wherein at least one work roll is operatively connected with bending devices, by which a bending moment can act on the work roll, and wherein the work roll chock has arms that project laterally relative to the axis of the work roll for absorbing the force produced by the bending devices.

A rolling device of this type is sufficiently well known in the prior art, e.g., EP 0 256 408 A2, EP 0 256 410 A2, DE 38 07 628 C2, and EP 0 340 504 B1. These documents disclose rolling devices in which two work rolls spaced a well-defined distance apart form the roll gap required for the rolling and are supported on backup rolls or intermediate rolls. The rolling device designed in this way can thus be equipped as a device with four or six rolls, such that the individual rolls can be vertically positioned relative to one another to produce the desired roll gap.

The work rolls are mounted in such a way that they can be moved axially, which makes it possible to influence the strip profile in strip rolling mills by a variable roll gap profile. The process-engineering possibility of axial movement of the work rolls is also becoming more and more important, first, for the purpose of systematically influencing the strip profile, and second, for the purpose of increasing the rolling campaigns by systematic wear distribution.

Another important refinement of the rolling device is that means are present for bending and balancing the work rolls. These means allow a bending moment to be introduced into the work rolls, which has advantages with respect to process engineering, as described in the documents cited above.

The work roll bending and shifting systems usually have stationary blocks in which the control mechanisms necessary for the bending and balancing and axial shifting are installed. They offer the advantage of fixed pressure medium feed lines, which do not have to be detached during a work roll change. To realize the bending and balancing, the rams are either mounted in a stationary way, in stationary blocks, which has the disadvantage of causing tilting moments that are not negligible during the axial shifting, or they are designed as cassettes that are also shifted during the axial shifting to allow better control of the tilting moments and frictional forces.

The previously known rolling devices reach their process-engineering limits when large roll gap heights must be used, e.g., in the case of plate rolling mills and roughing mills. The rams of the bending and balancing cylinders must be guided over significantly greater lengths and thus have a large space requirement in order to ensure the leverages that occur at large travel distances, even when the rams are fully extended.

The cited prior-art solutions realize relatively large roll gap heights with a combination of work roll bending and axial shifting only at the expense of the disadvantages mentioned above.

Short guide lengths of the rams of the bending and balancing cylinders are achieved only when the bending and balancing cylinders move together with the system comprising the work roll chock/backup roll chock, i.e., they are "cantilevered" so to speak between downwardly projecting arms of the backup roll or intermediate roll chock and laterally projecting fish plates of the work roll chock. In this regard, the ram can be installed either in the backup or intermediate roll chock or in the work roll chock; its installation in the backup or intermediate roll chock offers the advantage that the pressure medium feed lines do not have to be detached during a work roll change.

A solution of this type with "cantilevered" installation of the bending and balancing system in combination with an axial shift is disclosed in DE 101 50 690 A1, which provides that the axial shifting of the work roll is realized by a shifting cylinder arranged coaxially on the work roll chock. The shifting cylinder and the set of work rolls form a unit and are installed together in the rolling stand.

However, this results in the disadvantage that it is also necessary to provide an axial shifting cylinder for each set of replacement work rolls, which increases the capital costs of the rolling device.

The rolling device known from DE 101 50 690 A1 with "cantilevered" installation of the bending system—combined with a mechanism for axial shifting of the work rolls at the run-in and runout sides—is suitable for a large to very large roll gap height. However, this requires that the tilting moments that arise in these rolling devices from the axial shifting can be absorbed by a suitably rigid design of the backup roll bearing.

However, there are also flexible backup roll bearings. During the axial shifting, the upper set of work rolls is pushed by the bending cylinders of the upper backup roll chocks, which bending cylinders are being acted upon by balancing pressure. The frictional forces arising from this produce the aforementioned tilting moments and can produce an inclined position of the backup roll chocks. The maximum possible inclined position of the backup roll chocks is predetermined by the clearances of the backup roll bearing. Therefore, when sudden loading of the stand with rolling force occurs following the work roll shift ("initial pass impact"), the occurrence of local edge pressing and thus bearing damage in the long run cannot be ruled out, e.g., damage of the bearing bush or journal bush in flood lubricated bearings or overloading of individual bearing rows of roller bearings.

Therefore, good guidance of the work roll chocks even with a large roll gap height is not always ensured, and the aforesaid inclination of the backup roll chocks cannot always be avoided. This is not ensured when long bending and balancing cylinders are used. Furthermore, disadvantages occur when an axial shift of the work rolls is to be carried out, and a large or very large roll gap height is required.

Therefore, the objective of the invention is to create a rolling device of the aforementioned type that does not have the specified disadvantages. In particular, the objective is to create a rolling device with a bending and axial shifting system for the work rolls, which allows large roll gap heights.

In accordance with the invention, this objective is achieved by installing a pressure-transmitting element, which can be shifted relative to the rolling stand, especially in the vertical direction, between an element of the bending devices that generates compressive force, especially a piston, and the projecting arm of the work roll chock. In this connection, and the element of the bending devices that generates compressive force and the projecting arm of the work roll chock can be positioned in such a way that the center axis of the element that generates compressive force intersects the projecting arm.

This makes it possible to achieve transmission of the force of the bending devices that is optimized in such a way that the bending can be achieved with simultaneous axial shifting of the work rolls and a large roll gap height without the disadvantages mentioned above.

In a refinement of the invention , a sliding surface is provided between the element of the bending devices that generates compressive force and the pressure-transmitting element and/or between the pressure-transmitting element and the projecting arm of the work roll chock.

In a preferred embodiment, the bending devices are mounted in a block rigidly mounted in the rolling stand, and the pressure-transmitting element is supported on the block by means of a guide, especially a vertical guide. In this regard, it is advantages for the pressure-transmitting element to have U-shaped horizontal cross section and to surrounds the block, at least partially, on three sides. In addition, the pressure-transmitting element can have an L-shaped vertical cross section perpendicular to the axis of the work roll and at least partially surrounds the upper side of the block.

The guidance can be further improved in the case of variation of the roll separation by supporting the pressure-transmitting element on the rolling stand by means of a guide, especially a vertical guide. In addition, it has been found to be effective for holding devices to be installed between the block and the pressure-transmitting element, which hold the pressure-transmitting element stationary on the block in the direction towards the work roll.

The work rolls are generally provided with axial shifting devices for axial shifting of the work rolls, with which the work rolls can be brought into a desired axial position relative to the rolling stand and held there.

An especially good method of operation is achieved if the extent of the projecting arm of the work roll chock in the direction of the axis of the work roll is large in relation to the extent of the pressure-transmitting element measured in the direction of the axis at its part that is connected with the projecting arm, preferably at least twice as large.

Alternatively, it can also be provided that the extent of the projecting arm of the work roll chock in the direction of the axis of the work roll is small in relation to the extent of the pressure-transmitting element measured in the direction of the axis at its part that is connected with the projecting arm and preferably is no more than half as large.

The proposed design of a rolling device ensures good guidance of the work roll chocks even at a large roll gap height and avoids an inclined position of the backup roll chocks. For this purpose, the work roll bending device can be equipped with stationary blocks, in which long bending and balancing cylinders can operate but which are freed of the tilting moments by the additional measures that have been specified. The proposed rolling device is suitable for a large roll gap height and nevertheless can be realized with a compact construction.

The drawings illustrate specific embodiments of the invention.

Figure 1:
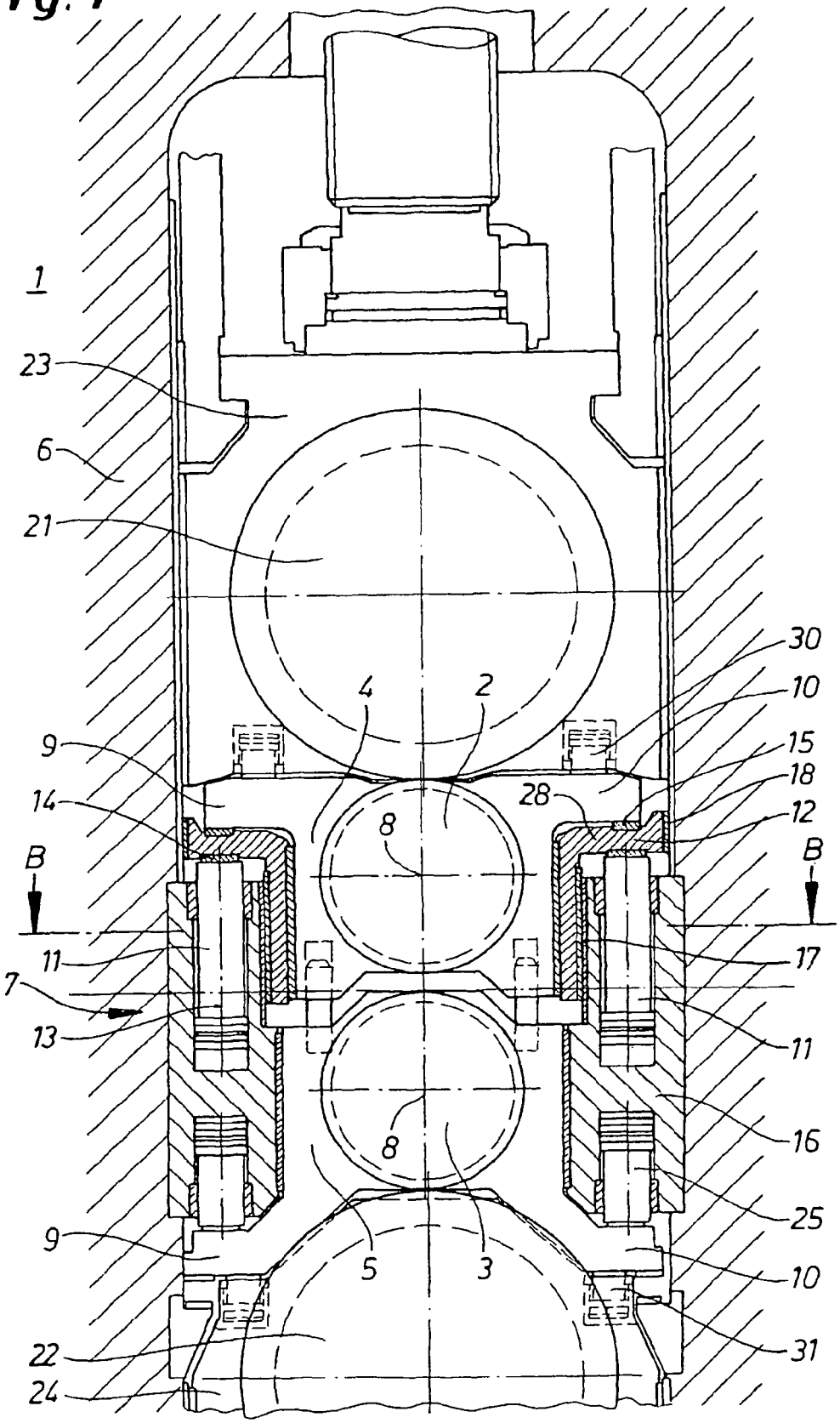
FIG. 1 shows a detail section of a first embodiment of a rolling device with bending devices, viewed in the axial direction of the rolls, in a front-elevational view along sectional line A-A in FIG. 2.
Figure 2:
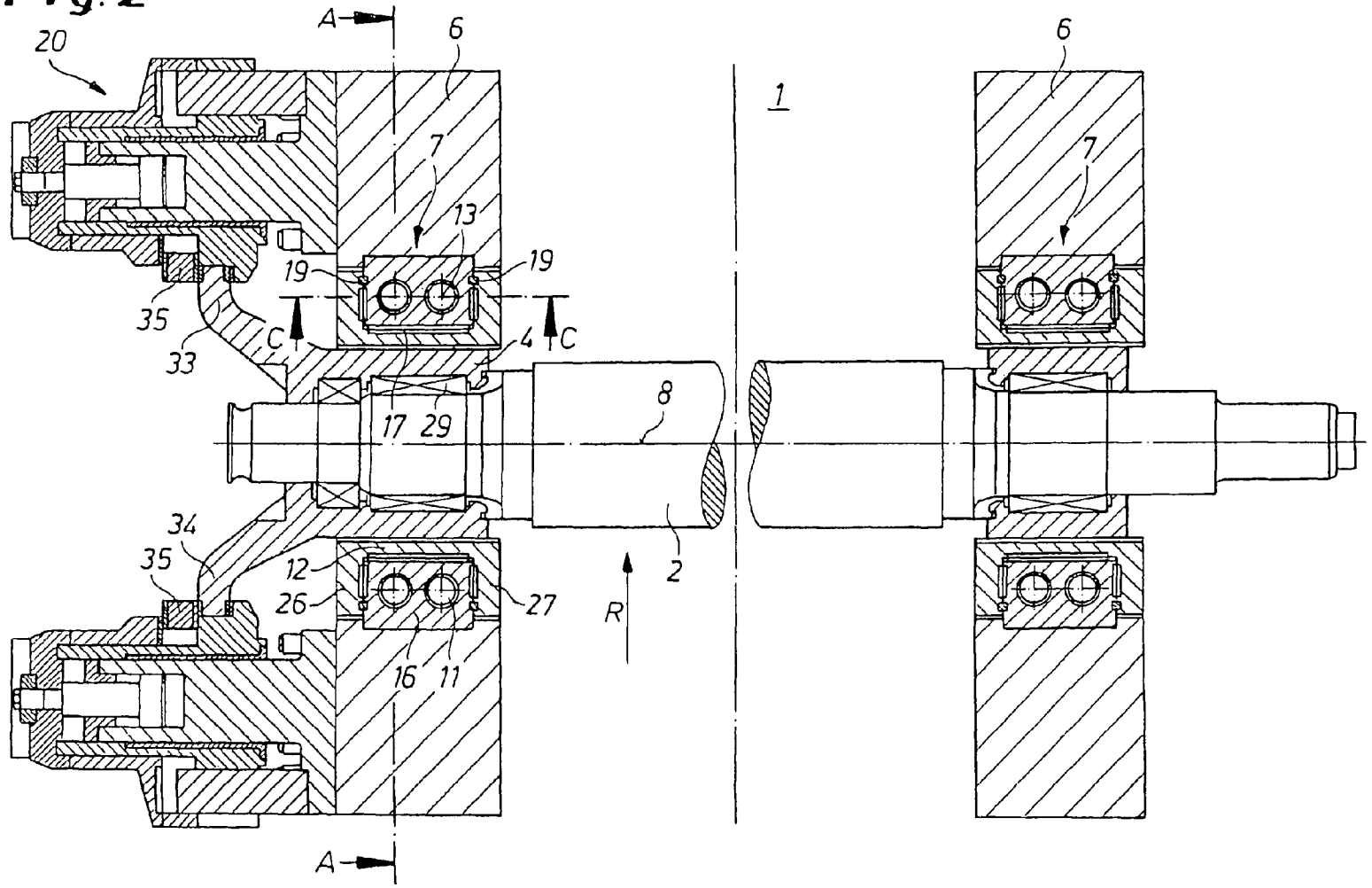
FIG. 2 shows the top view of the rolling device along sectional line B-B in FIG. 1.
Figure 3:
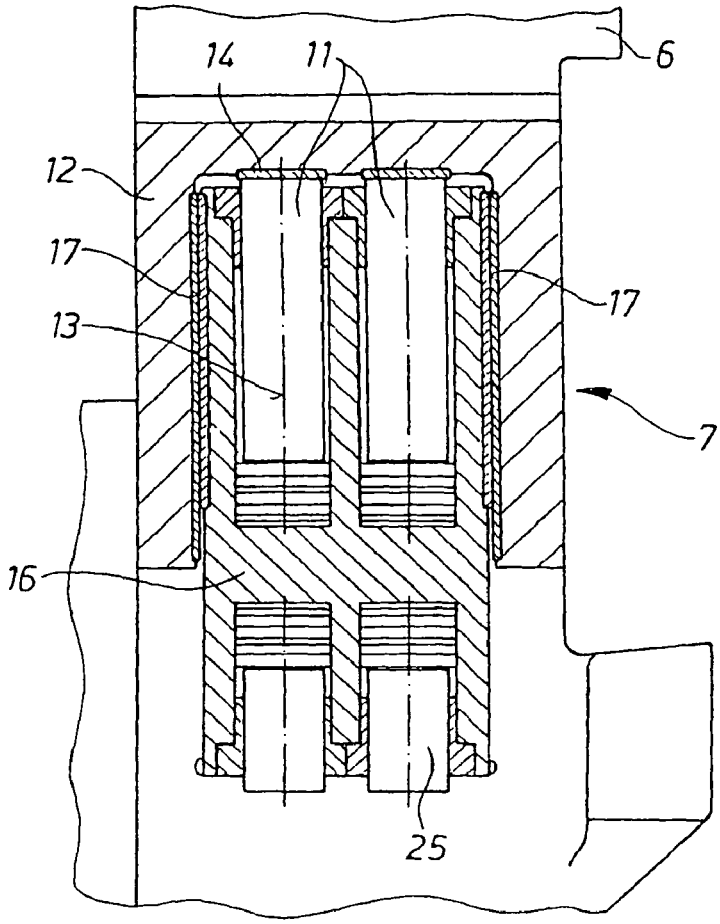
FIG. 3 shows a side view of the bending devices along sectional line C-C in FIG. 2.

FIGS. 1 to 3 show a rolling device 1, in which two interacting work rolls 2 and 3, each of which is supported in a work roll chock 4 and 5, respectively, are mounted in a rolling stand 6. To set essentially any desired roll gap between the two work rolls 2 and 3, the upper work roll chock 4 is designed to be vertically adjustable, i.e., it can be moved in the vertical direction relative to the rolling stand 6.

The work rolls 2, 3 are supported by backup rolls 21 and 22, respectively, which are supported in a backup roll chock 23 and 24, respectively. The illustrated rolling device 1 thus has four rolls all together. It should be noted that it can also have additional rolls, namely, intermediate rolls arranged between the work rolls 2, 3 and the backup rolls 21, 22.

Bending devices 7 are provided for introducing a bending moment into the work rolls 2, 3. As especially FIG. 2 shows, the bending devices 7 are mounted in both axial end regions of the work rolls 2, 3 and on both the run-in side and the runout side of the rolling stand 6. A total of four bending devices 7 are provided.

The bending devices 7 have a block 16, which is rigidly mounted on the rolling stand 6, as especially FIG. 1 shows. The block 16 has cylindrical bores, in which elements 11 that generate compressive force, i.e., pistons, are mounted and can be acted on with hydraulic pressure. The pistons 11 have a center axis 13, which extends in the vertical direction.

FIG. 1 also shows that each work roll chock 4, 5 has projecting arms 9 and 10, which are arranged laterally relative to the axes 8 of the work rolls 2, 3. The projecting arms 9, 10 extend laterally towards the outside—away from the work roll 2, 3—and overlap the pistons 11 beyond their center axes 13.

A pressure-transmitting element 12 is mounted between the bending devices 7 and especially their pistons 11 and the projecting arms 9, 10 of the work roll chocks 4, 5. It has two sliding surfaces 14 and 15, which provide for good sliding conditions between the pistons 11 and the pressure-transmitting element 12 at one end, and between the pressure-transmitting element 12 and the projecting arm 9, 10 at the other end. As is also shown, the piston 11 and the projecting arm 9, 10 are positioned in such a way that the center axis 13 of the piston 11 intersects the projecting arm 9, 10. This results in optimum transmission of force from the bending device 7 to the work roll chock 4, 5.

The pressure-transmitting element 12 is mounted on the block 16 by means of a vertical guide 17 and can thus move in the vertical direction relative to the block 16 and thus relative to the rolling stand 6. Similarly, another vertical guide 18 is provided, which guides the pressure-transmitting element 12 in the upper region on the rolling stand 6, especially a crosshead 28 of the pressure-transmitting element 12.

The pressure-transmitting element 12 is formed as a "bending hood". This means that it has a U-shaped horizontal cross section and surrounds the block 16, at least partially, on three sides, as is best shown in FIG. 2. FIG. 1 shows that the pressure-transmitting element 12 has an L-shaped vertical cross section perpendicular to the axis 8 of the work roll 2, 3 and partially surrounds the upper side of the block 16. The pressure-transmitting element 12 is arranged with its two sidepieces 26 and 27 (see FIG. 2) on the sides of the block 16 in such a way that it can slide vertically but resists tilting against axial shifting forces. In addition, it is supported on the end face of the block 16 facing the work roll 2 and can thus absorb large horizontal forces, which can be directed in the opposite direction from the rolling direction at the run-in and in the same direction as the rolling direction at the runout.

As is also shown, both in the rolling direction and against the rolling direction, the pressure-transmitting element 12 is provided with additional sliding surfaces, which are located on the sidepieces 26, 27 and can provide support on the lateral surfaces of the rolling stand 6 facing the work roll 2. So that the pressure-transmitting element 12 stays in place when the work roll 2, 3 is removed and does not fall off the rolling stand 6 or the block 16, holding devices 19 are provided (see FIG. 2), which prevent the pressure-transmitting element 12 from moving in the direction R towards the roll axis 8.

As is also shown, axial shifting devices 20 are present for axial adjustment of the work roll 2, 3.

FIG. 3 shows that in addition to the upwardly acting elements (pistons) 11 of the bending device 7 that generate compressive force and act on the upper work roll chock 4, other force-generating elements 25 are provided, which generate a downwardly directed force and act on the lower work roll chock 5 with a bending force.

Figure 5:
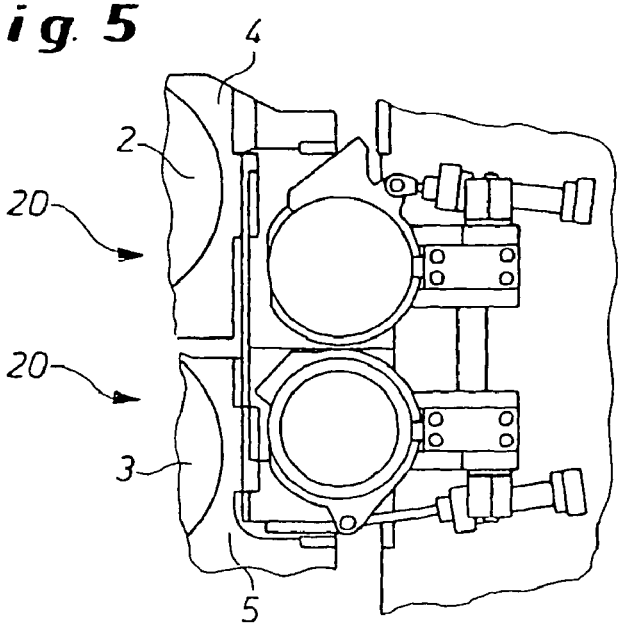
FIG. 5 shows the view X in FIG. 4.
Figure 4:
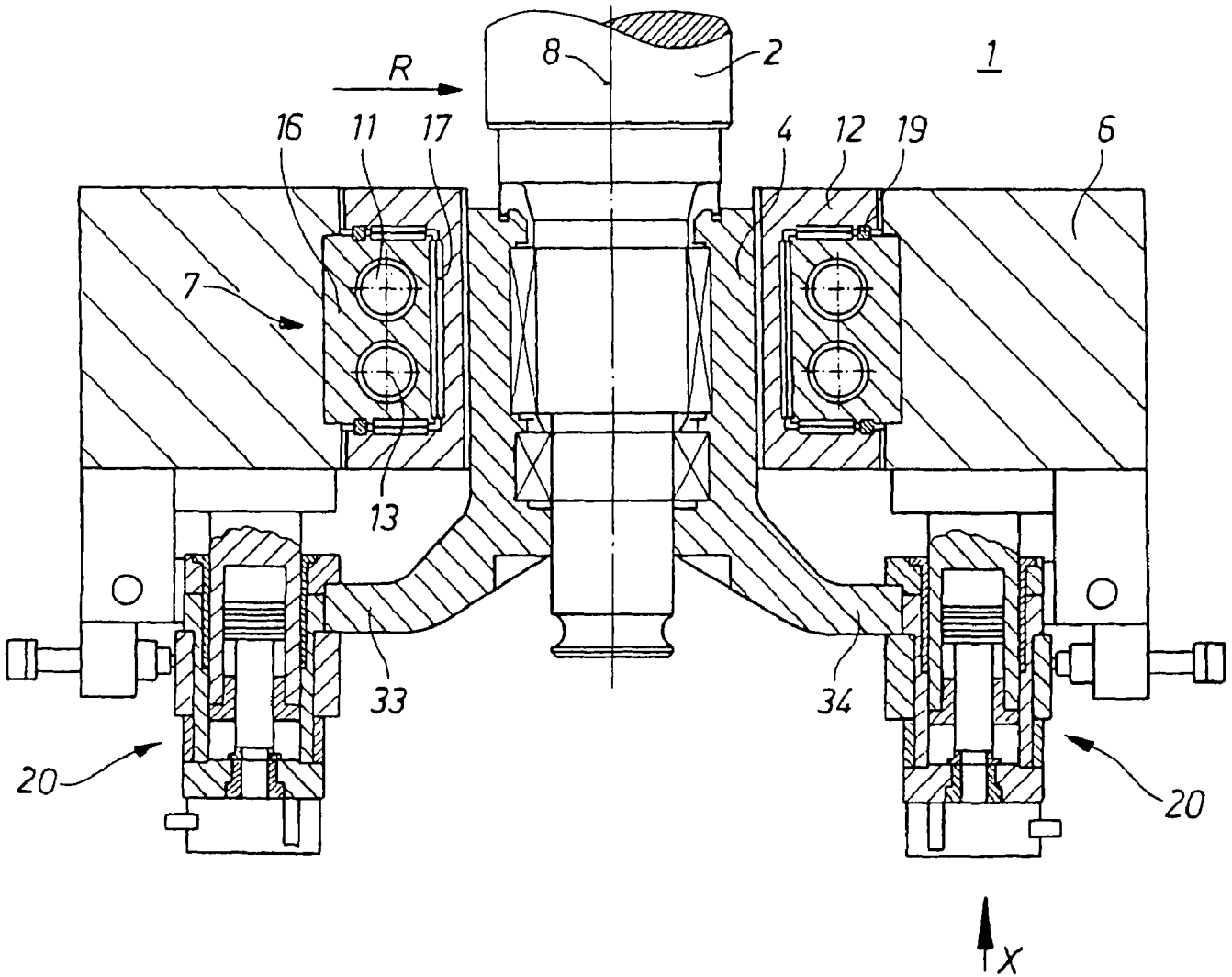
FIG. 4 shows an alternative embodiment to FIG. 2.

FIGS. 4 and 5 show a modified design of the rolling device 1. FIG. 5 shows that again each of the work rolls 2, 3 is provided with an axial shifting device 20.

Problems with a large roll gap height combined with axial shifts of the work rolls arise mainly in the upper sets of rolls. Therefore, in the embodiment shown in FIG. 1, a "bending hood" is provided only in that location. FIG. 1 shows that the lower elements 25 for generating compressive force act without a "bending hood" (pressure-transmitting element 12) on the lower work roll chock. It should be noted, however, that a pressure-transmitting element 12 can also be provided here between the piston 25 and the work roll chock 5.

The proposed "bending hood" in the form of the pressure-transmitting element 12 ensures good guidance of the work roll chocks 4, 5 even with a large and very large roll gap height. At the same time, the frictional forces are absorbed, which would otherwise skew the backup roll chocks 23, 24 and produce tilting moments during an axial shift of the work rolls.

To form the contact between the crosshead 28 of the pressure-transmitting element 12 (see FIG. 1) and the projecting arm 9, 10, two variants are possible:

The contact surface of the projecting arm 9, 10 can be designed short in the direction of axial shifting and can be located centrally to the work roll bearing 29, while the opposite surface of the crosshead 28 is designed long. In this case, the work roll bearing 29 is centrally loaded even after the axial shift has occurred, which is advantageous. Although this design results in uneven loading of several elements 11 that generate compressive force, which are arranged below the crosshead 28—in the specific embodiment, two pistons 11 per bending device 7 are provided side by side—this can be compensated by a "pressure balance", as is already known from the prior art.

Alternatively, the contact surface associated with the crosshead 28 can be designed short in the direction of axial shifting and thus can be located centrally to the work roll bearing 29 only in the unshifted position. The opposite surface under the projecting arm 9, 10 can be designed long. During the axial shift, the elements 11 of the bending device 7 that generate compressive force now advantageously continue to be evenly loaded, but, of course, now the work roll bearing 29 is no longer centrally loaded.

In the specific embodiment, the blocks 16 of the upper bending devices 7 are surrounded by the pressure-transmitting elements 12. The roll gap is adjusted essentially by the upper work roll 2. In this regard, the upper work roll 2 is pressed against the upper backup roll 21, which was preset by mechanical adjustment, by means of the upper bending devices 7 and the pressure-transmitting element 12.

The blocks 16 can also be surrounded by pressure-transmitting elements 12 in the region of the lower bending devices 7 illustrated in FIGS. 1 and 3.

Besides the so-called positive work roll bending by means of the bending devices 7, to increase the operating range for controlling the profile, so-called negative work roll bending can also be realized by means of additional piston-cylinder systems 30, 31 (see FIG. 1).

In general, the bending system that has been described can be combined in an advantageous way with different variants of work roll shifting systems. These can be, for example, axial shifting systems with two separate axial shifting units per set of work rolls, e.g., with a special locking mechanism suitable for a large roll gap height and translational locking movement or with a conventional locking mechanism and rotational locking movement.

FIGS. 6 to 15 illustrate a preferred design of the axial shifting devices.

Figure 6:
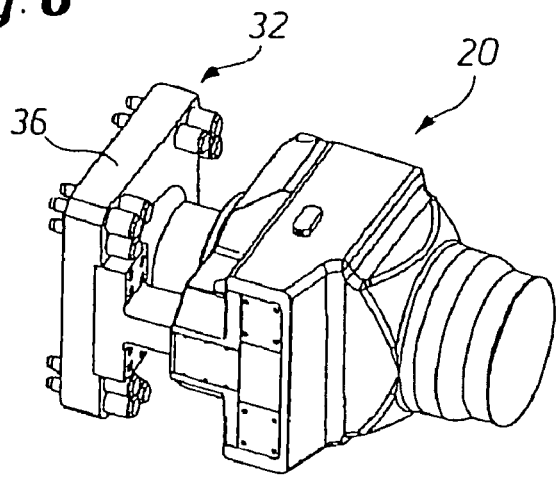
FIG. 6 shows a perspective view of an axial shifting device for the axial shifting of the work roll.
Figure 7:
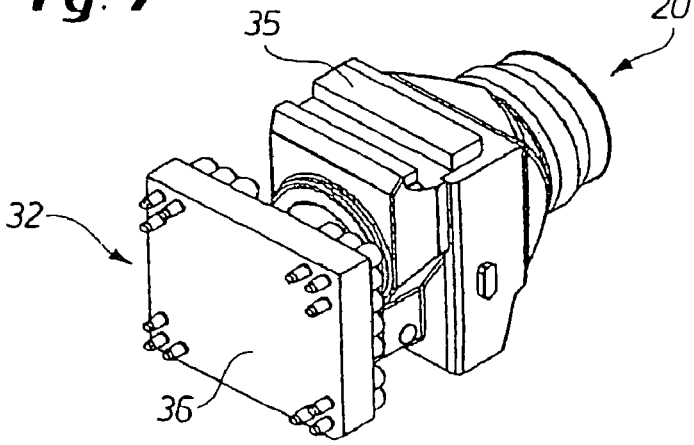
FIG. 7 shows the same axial shifting device in a somewhat different perspective view.
Figure 8:
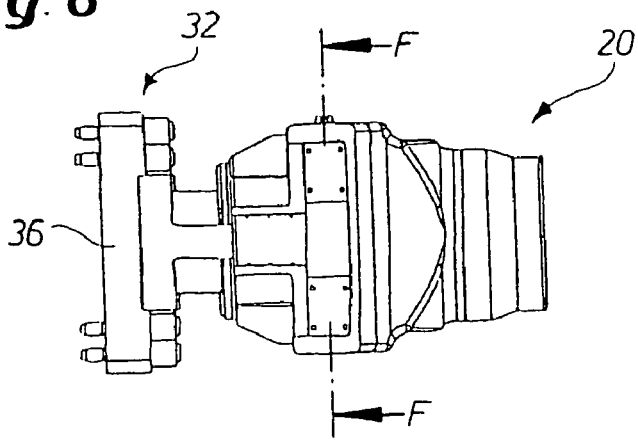
FIG. 8 shows the axial shifting device of FIGS. 6 and 7 in a side view.
Figure 10:
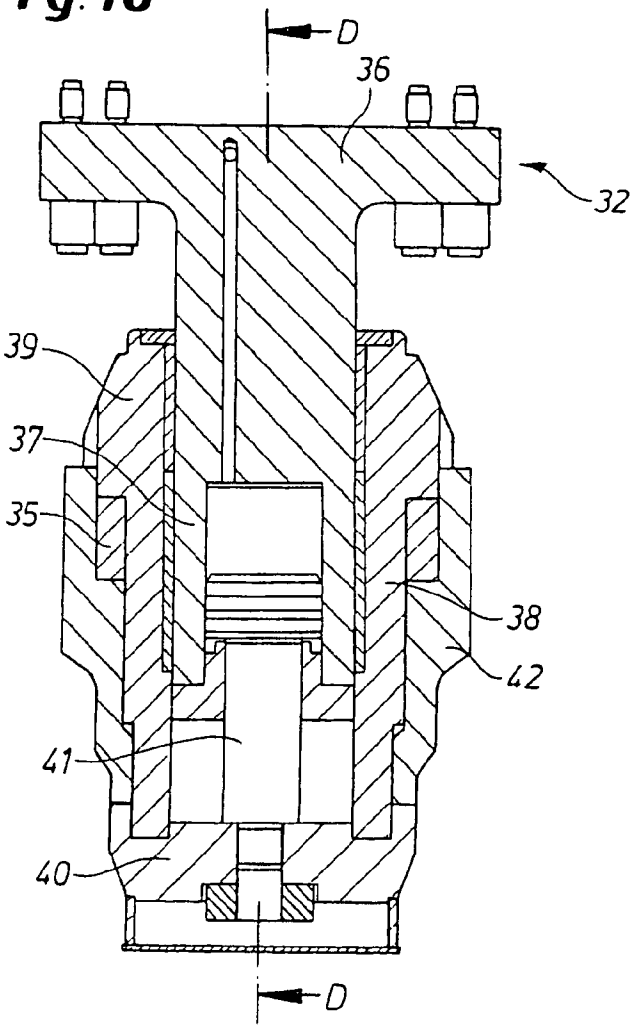
FIG. 10 shows a top view of the axial shifting device along sectional line E-E in FIG. 9.
Figure 9:
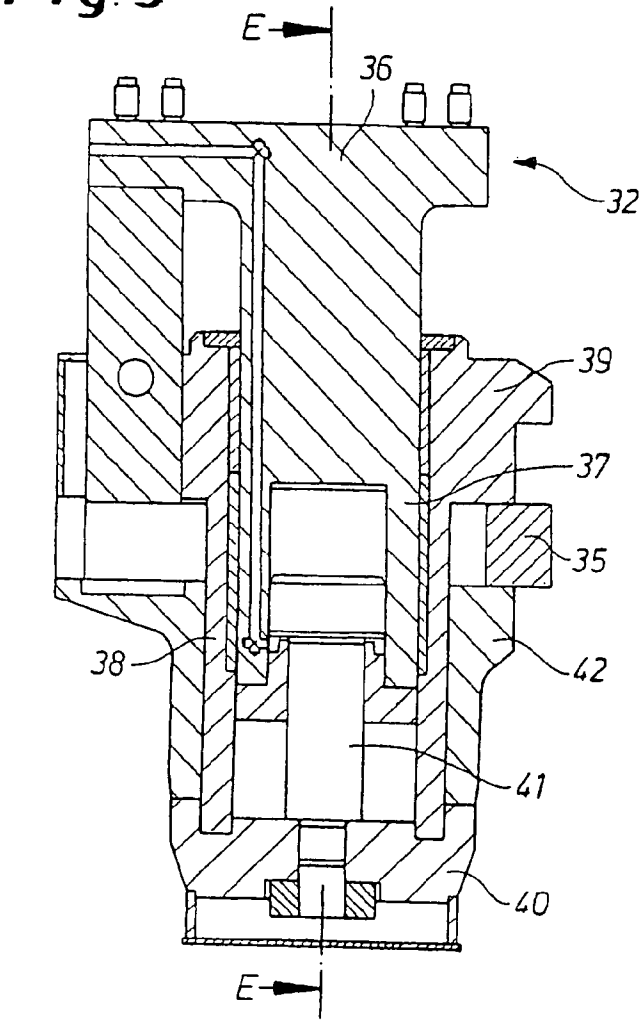
FIG. 9 shows a side view of the axial shifting device along sectional line D-D in FIG. 10.

The axial shifting devices 20 are shown first in two different perspective views in FIGS. 6 and 7. FIG. 8 shows a side view of the axial shifting device 20.

The details of the design of the axial shifting device 20 are shown in FIGS. 9 to 15.

The axial shifting devices 20 are located above and below the pass line and on both the run-in side and the runout side of the rolling stand 6. Solutions for work roll shifting devices above the pass line are problematic for a large roll gap height. Solutions for work roll shifting devices below the pass line can be built conventionally or like those for a large roll gap height. The devices on the run-in and runout side are essentially identical and symmetric to each other, so that here we shall describe only axial shifting devices 20 with a large roll gap height that lie above the pass line as representative of all of the axial shifting devices.

As is already apparent from FIGS. 2 and 4, an axial shifting device 20 is provided on either side of the center of the work roll 2, 3. These devices are rigidly mounted with one of their axial ends 32 on the rolling stand 6. In the region of the sectional line F-F (FIG. 8) of the axial shifting device 20, there is a work roll locking mechanism, with which the work roll chock 4, 5 can be detachably locked in place. The work roll chock 4, 5 has two arms 33, 34 (see FIG. 2), which extend symmetrically from the axis 8 of the work roll 2, 3. In the locked position, the ends of the arms 33, 34 are held in the axial shifting device 20 in a receiving slot, which extends vertically and offers the possibility that the work roll chock 4, 5 and thus the work roll 2, 3 can be vertically positioned and secured at the height in the rolling stand 6 that corresponds to the required roll gap. The receiving slot is bounded on one side by a linear guide 54 (see FIG. 15), which has the work roll locking mechanism, and it is bounded on the other side by a lock 35, which will be described in detail later.

The axial shifting device 20 consists of a flange 36 that is rigidly connected to the rolling stand 6. The flange 36 projects outward and forms the base of a guide tube 37. A shifting head 38 is slidingly arranged on the outside diameter of the guide tube 38.

The shifting head 38 consists of a shifting tube 39 with guide bushes and a cover 40. A shifting piston 41 is rigidly coaxially connected with the lid 40.

Suitable means are used to ensure that torsion of the axial shifting device 20 in its axial direction is prevented, i.e., torsion of one axial end 32 relative to the other axial end of the axial shifting device 20 is prevented.

Various embodiments of means for preventing this torsion are conceivable. One possibility is to provide a part that is mounted on the shifting tube 39 outside the central axis. The antitorsion device must have a sufficiently long guide to prevent torsion of the axial shifting device 20 for the entire maximum shift distance.

In addition, there is a position measuring system (illustrated in FIG. 9), with which it is possible to measure the current axial position of the work rolls 2, 3.

The work roll locking mechanism is mounted on the axial shifting device 20. The principal part of this locking mechanism is a coupling 42 with the lock 35; the latter is shown in cross section in FIG. 11. The lock 35 is connected with operating devices 43, 44. In the locked state, the work roll locking mechanism is positively locked with the arms 33, 34 of the work roll chock 4, 5. The axial shifting devices 20 are mounted on the rolling stand 6 on the run-in and runout sides with essentially mirror symmetry.

The coupling 42 is designed in such a way that, together with the shifting tube 39, it forms a chamber, in which the lock 35 is securely supported. In addition, its flanks are supported on the shifting tube 39 in such a way that forces perpendicular to the flanks and torques are absorbed by the axis of the shifting tube 39. If the lock 35 presses against one of the flanks of the coupling 42, the other flank is supported on another surface of the shifting tube 39 and vice versa.

An axial shift of the work roll 2, 3 is produced by operation of the axial shifting device 20 and as a result of the positive locking between the work roll locking mechanism and the work roll chock 4, 5.

The lock 35 is mounted on the coupling 42 to allow locking. The lock 35 embraces the shifting tube 39, and to close the locking mechanism, it can be moved approximately horizontally transversely to the axis of the shifting tube 39. When the lock 35 is moved into the locking position, a vertically oriented receiving slot is formed, in which the laterally projecting arms 33, 34 of the work roll chock 4, 5 are supported.

The vertically oriented receiving slot absorbs the axial shifting forces, which must be passed along by the laterally projecting arms 33, 34 of the work roll chock 4, 5, and at the same time allows large relative movements in the vertical direction. The result of this is the creation of a large roll gap height. The vertically oriented receiving slot is opened to allow removal of the work rolls by withdrawing the lock 35. The set of work rolls can then be pulled out towards the service side.

Details of the design of the work roll locking mechanism by means of the lock 35 are shown in FIGS. 11 to 14. The lock 35 can have an O-shaped or U-shaped recess (in FIG. 11, the recess is O-shaped). The lock 35 is not mounted in front of the head of the cover 40, but rather it embraces the shifting tube 39. The recess in the lock 35 is sufficiently large that the lock can be mounted by pushing it onto the shifting tube 39 axially in the case of an O-shaped design or axially or radially in the case of a U-shaped embodiment. As a closed shape, the O-shape is the more rigid embodiment of the lock 35.

In its U-shaped embodiment, the lock 35 is open on the opposite side of the shifting tube 39 from the work roll chock 4, 5. Because the lock 35 embraces the shifting tube 39, the work roll bending arm (measured from the center of the work roll bearing 29) can be smaller than if the lock were mounted in front of the head of the cover 40. This advantageously reduces the lever arm between the work roll bearing 29 and the vertical guide on the shifting head 38. The result of a smaller lever arm is that the frictional forces in the guide exert only relatively small additional moments on the work roll bearing 29, and this increases the service life of the bearing.

Another advantage of the short construction is that the shifting system requires a smaller amount of space in front of the rolling stand for the sets of rolls that have been withdrawn and are to be replaced, especially if a transverse shift of the sets of work rolls is provided during the roll change.

Because a translational movement of the locking mechanism requires less space than a rotational locking mechanism (as is customary in rolling mills with a small roll gap height), it is better suited for a large roll gap height.

The closing and opening of the receiving slot for the laterally projecting arms 33, 34 of the work roll chock 4, 5 are brought about by a horizontal or approximately horizontal movement of the lock 35 with a corresponding locking stroke. Therefore, the recess in the lock 35 is larger in the direction of movement (horizontal) by at least the amount of the locking stroke than is necessary for mounting.

Figure 11:
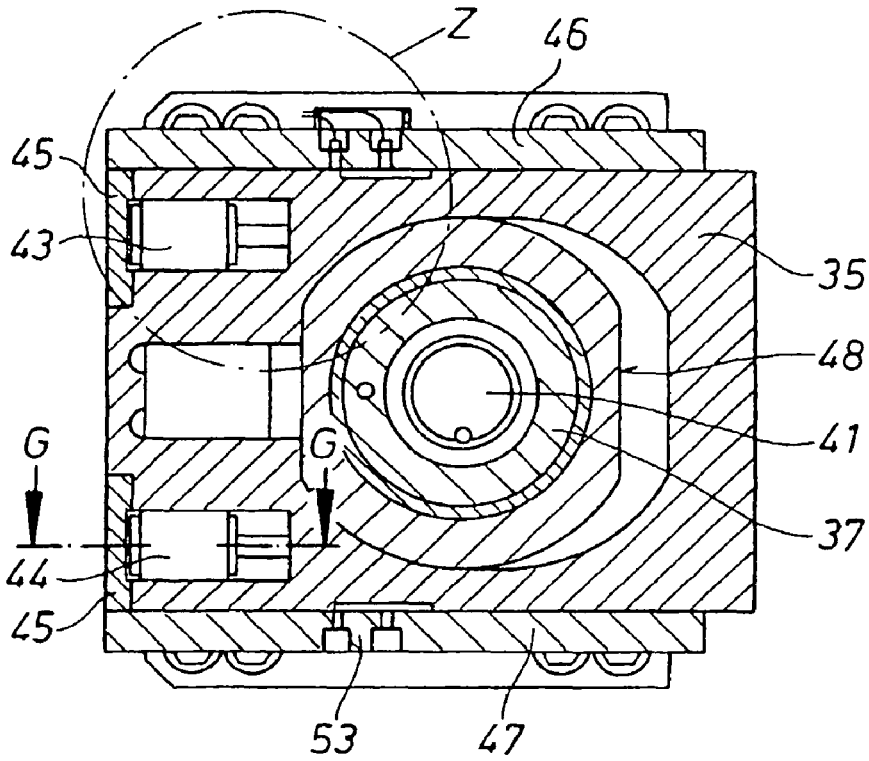
FIG. 11 shows a front elevation of the axial shifting device along sectional line F-F in FIG. 8.
Figure 12:
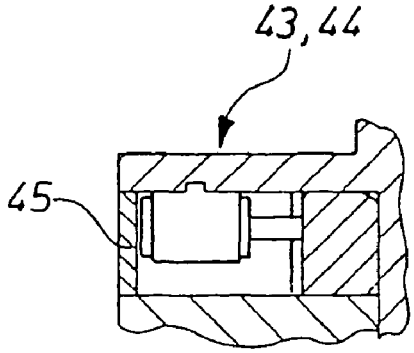
FIG. 12 shows a detail section of the axial shifting device along sectional line G-G in FIG. 11.
Figure 13:
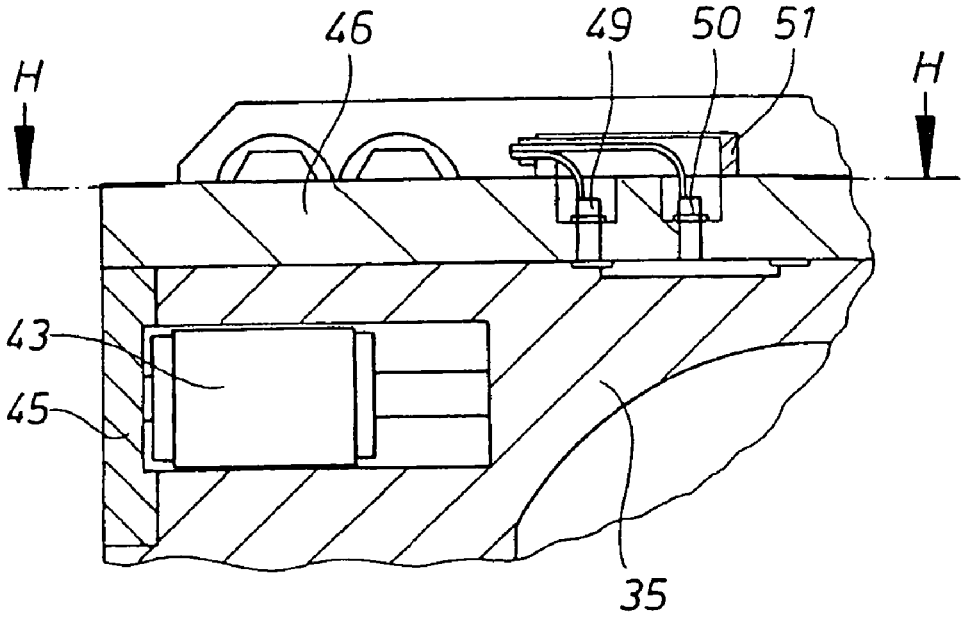
FIG. 13 shows the detail section Z in FIG. 11.
Figure 14:
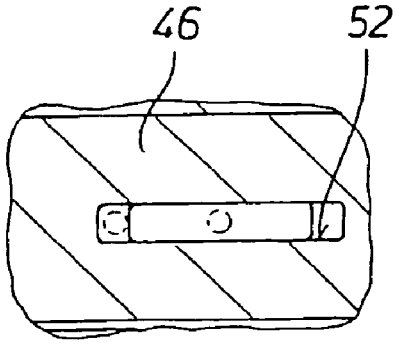
FIG. 14 shows the sectional line H-H in FIG. 13.
Figure 15:
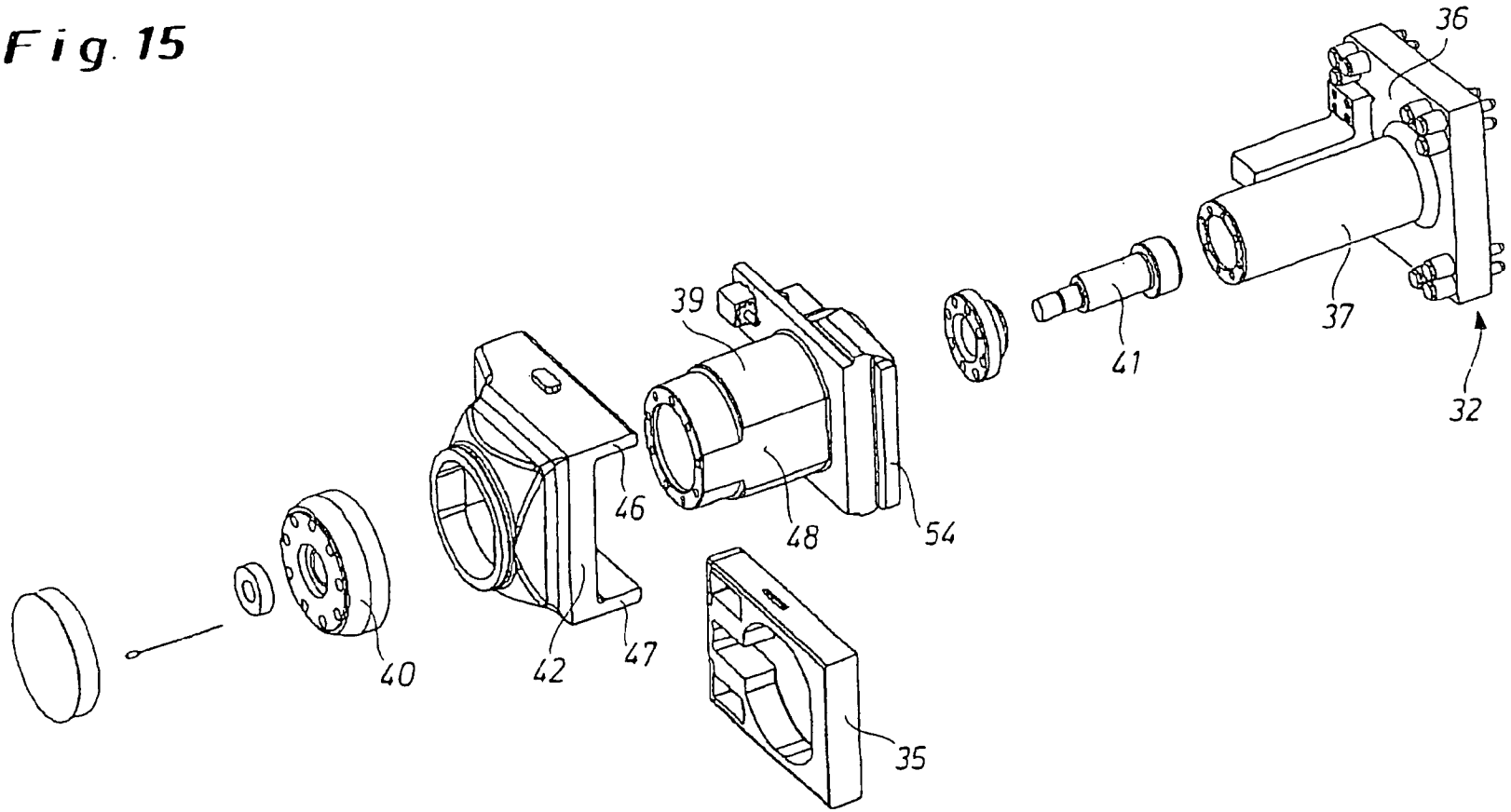
FIG. 15 shows an exploded view of the axial shifting device.

The lock 35 is moved by the operating devices 43, 44. These are, for example, one or more operating elements in the form of piston-cylinder systems (hydraulic cylinders with through piston rods)—in this regard, see FIG. 12, which shows the section along sectional line G-G in FIG. 11. The piston-cylinder systems are advantageously mounted on the side of the lock 35 that faces away from the work roll chock 4, 5. It is especially space-saving if two piston-cylinder systems 43, 44 are placed above and below in recesses in the lock 35. This embodiment is illustrated in FIG. 11. FIG. 12 shows a piston-cylinder system 43, 44 in detail.

For reasons of space, it is useful to provide still another recess in the lock 35, namely, to allow the passage of elements of the antitorsion devices and avoid a collision with them.

In the specific embodiment shown in FIG. 11, the lock 35 has three recesses, one large recess for the shifting tube 39, two smaller recesses for the piston-cylinder systems 43, 44, plus an additional recess to prevent collision with the devices for preventing torsion of the axial shifting device 20.

It is advantageous for the recesses for the piston-cylinder systems 43, 44 to be closed with clamps 45 in the lock 35, so that the piston-cylinder systems 43, 44 can be removed at the side without having to remove the coupling 42 or other parts.

The lock 35 is held in the open or closed position by the piston-cylinder systems 43, 44. However, it must be additionally secured in a suitable way against torsion towards an axis parallel to or identical to the central axis of the shifting tube 39. This is accomplished by the flanks 46 and 47 of the coupling 42, which in turn are supported on the shifting tube 39. In this way, the torsion is absorbed in a short distance.

One or more flat surfaces 48 can be provided on the shifting tube 39 to make some room for the locking movement.

The position of the lock 35 can be checked by two position sensors 49, 50, which are mounted in a suitable way in the coupling 42 and are thereby protected from environmental influences by a protective housing 51. The position sensors 49, 50 check the terminal position of the lock 35, in which special grooves 52 have been formed for this purpose (see FIG. 14, which shows the section along sectional line H-H in FIG. 13).

A groove 52 of this type has a deep hollow in the middle, which is about twice as long as the locking movement, while at each end it has only a shallow hollow. Optionally, one of the position sensors 49, 50 is located above one of the shallow hollows and passes on the current lock position. The shallow hollows have the special advantage that theoretically flush-mounted position sensors 49, 50 are not sheared off if they do actually protrude slightly. If a position sensor 49, 50 is located above one of the deep hollows, it can no longer detect the lock 35. The corresponding bores and recesses can be advantageously placed symmetrically above and below, so that the position sensors 49, 50 can be screwed in in suitable places, and the vacant position can be closed, e.g., with a cover 53 (see FIG. 11).

The measurement of the axial shift distance (see FIG. 9) is made possible by a unit located outside or inside the axial shifting device 20. Arrangement of the primary measuring element inside the pressure system should be avoided if at all possible due to the risk this poses during maintenance work. The position measuring system can be designed as an internal or external unit. In the case of an external unit, protection from detrimental environmental influences is necessary. This can be achieved by an enclosed system similar to a hydraulic cylinder. A type of piston, which is rigidly mounted on the upright, slides through a cylindrical tube, which is mounted on the moving parts of the axial shifting system. The primary measuring element moves coaxially with the cylindrical tube and generates the corresponding position signal. Adequate protection of the system is provided with suitable sealing and wiping elements. In the case of an internal unit, the position sensor—viewed from the end face of the moving parts—is inserted into the shifting sleeve or shifting tube. The necessary enclosure is produced by the shifting system itself. A suitably sealed housing protects the electronic part of the position sensor.

Arrangement of a position sensor rod inside the axial shifting device 20—but nevertheless outside the pressure space—is advantageous, because this element is then protected from environmental influences without additional enclosures. The position sensor can be mounted on the cover 40. The position sensor rod can be passed through a hole in the cover 40 and enter a hole in an inner cover.

The proposed design makes it possible to achieve an arrangement of the bending devices and axial shifting devices with which tilting moments that arise during axial shifting of the work rolls can be optimally absorbed. The design of the rolling device prevents collisions of the various parts with one another, even when large roll gap heights are used. However, a large amount of installation space in the rolling stand is not required.

LIST OF REFERENCE SYMBOLS

1 rolling device
2 work roll
3 work roll
4 work roll chock
5 work roll chock
6 rolling stand
7 bending device
8 axis of the work roll
9 projecting arm
10 projecting arm
11 element (piston) of the bending device that generates compressive force
12 pressure-transmitting element
13 center axis of the element that generates compressive force
14 sliding surface
15 sliding surface
16 block
17 guide (vertical guide)
18 guide (vertical guide)
19 holding device
20 axial shifting device
21 backup roll
22 backup roll
23 backup roll chock
24 backup roll chock
25 element (piston) of the bending device that generates compressive force
26 sidepiece
27 sidepiece
28 crosshead
29 work roll bearing
30 piston-cylinder system
31 piston-cylinder system
32 axial end
33 arm
34 arm
35 lock
36 flange
37 guide tube
38 shifting head
39 shifting tube
40 cover
41 shifting piston
42 coupling
43 operating device
44 operating device
45 clamp
46 flank
47 flank
48 flat surface
49 position sensor
50 position sensor
51 protective housing
52 groove
53 cover
54 linear guide
R direction towards the work roll

The invention claimed is:

1. Rolling device (1) with at least two work rolls (2, 3), each of which is supported by a work roll chock (4, 5) in a rolling stand (6), wherein at least one of the work rolls (2, 3) in the rolling stand (6) can be adjusted, especially in the vertical direction, for the purpose of adjusting a desired roll gap relative to the other work roll (2, 3), wherein at least one work roll (2, 3) is operatively connected with bending devices (7), by which a bending moment can act on the work roll (2, 3), and wherein the work roll chock (4, 5) has arms (9, 10) that project laterally relative to the axis (8) of the work roll (2, 3) for absorbing the force produced by the bending devices (7), wherein a pressure-transmitting element (12), which can be shifted relative to the rolling stand (6), especially in the vertical direction, is installed between an element (11) of the bending devices (7) that generates compressive force, especially a piston, and the projecting arm (9, 10) of the work roll chock (4, 5), such that the element (11) of the bending devices (7) that generates compressive force and the projecting arm (9, 10) of the work roll chock (4, 5) are positioned in such a way that the center axis (13) of the element (11) that generates compressive force intersects the projecting arm (9, 10), such that the bending devices (7) are mounted in a block (16) rigidly mounted on the rolling stand (6), and the pressure-transmitting element (12) is supported on the block (16) by means of a guide (17), especially a vertical guide, and such that the pressure-transmitting element (12) has a U-shaped horizontal cross section and surrounds the block (16), at least partially, on three sides, and the pressure-transmitting element (12) has an L-shaped vertical cross section perpendicular to the axis (8) of the work roll (2, 3) and at least partially surrounds the upper side of the block (16), wherein the pressure-transmitting element (12) is supported directly on the rolling stand (6) by a vertical guide (18) provided on the rolling stand.

2. Rolling device in accordance with claim 1, wherein a sliding surface (14, 15) is arranged between the element (11) of the bending devices (7) that generates compressive force and the pressure-transmitting element (12) and/or between the pressure-transmitting element (12) and the projecting arm (9, 10) of the work roll chock (4, 5).

3. Rolling device in accordance with claim 1, wherein holding devices (19) are installed between the block (16) and the pressure-transmitting element (12), which hold the pressure-transmitting element (12) stationary on the block (16) in the direction (R) towards the work roll (2, 3).

4. Rolling device in accordance with claim 1, wherein the work rolls (2, 3) are provided with axial shifting devices (20) for axial shifting of the work rolls (2, 3), with which the work rolls (2, 3) can be brought into a desired axial position relative to the rolling stand (6) and held there.

5. Rolling device in accordance with claim 1, wherein the extent of the projecting arm (9, 10) of the work roll chock (4, 5) in the direction of the axis (8) of the work roll (2, 3) is large in relation to the extent of the pressure-transmitting element (12) measured in the direction of the axis (8) at its part that is connected with the projecting arm (9, 10), preferably at least twice as large.

6. Rolling device in accordance with claim 1, wherein the extent of the projecting arm (9, 10) of the work roll chock (4, 5) in the direction of the axis (8) of the work roll (2, 3) is small in relation to the extent of the pressure-transmitting element (12) measured in the direction of the axis (8) at its part that is connected with the projecting arm (9, 10) and preferably no more than half as large.

* * * * *